United States Patent [19]

Santilli

[11] Patent Number: 4,659,640

[45] Date of Patent: Apr. 21, 1987

[54] SELF-FIXING LIQUID ELECTROGRAPHIC DEVELOPERS CONTAINING POLYESTER TONERS AND DISPERSED WAX AND PROCESSES FOR USING THE SAME

[75] Inventor: Domenic Santilli, Webster, N.Y.

[73] Assignee: Eastman Kodak Company, Rochester, N.Y.

[21] Appl. No.: 390,487

[22] Filed: Jun. 21, 1982

[51] Int. Cl.[4] ..... G03G 9/12

[52] U.S. Cl. ..... 430/119; 430/114

[58] Field of Search ..... 430/114, 117

[56] References Cited

U.S. PATENT DOCUMENTS

| | | | |
|---|---|---|---|
| 2,891,911 | 6/1959 | Mayer et al. | 430/115 |
| 3,301,698 | 1/1967 | Fauser et al. | 117/37 |
| 3,850,829 | 7/1972 | Smith et al. | 252/62.1 |
| 3,954,640 | 5/1976 | Lu et al. | 252/62.1 L |
| 3,985,665 | 12/1976 | Sakaguchi et al. | 430/904 |
| 3,997,488 | 12/1976 | Tsubuko et al. | 430/137 X |
| 4,052,325 | 10/1977 | Santilli | 430/114 |

FOREIGN PATENT DOCUMENTS 1035837 7/1966 United Kingdom .

*Primary Examiner*—J. David Welsh
*Attorney, Agent, or Firm*—David F. Janci

[57] ABSTRACT

A novel liquid electrographic developer containing a volatile, electrically insulating carrier liquid, polyester toner particles, and wax dispersed in the carrier is described. The wax-to-polyester weight ratio in the developer is sufficiently high, preferably above 0.25, thereby rendering the developer self-fixing at room temperature.

A novel process for developing an electrostatic latent image on a smooth support using a self-fixing liquid developer is also described. Upon application of the developer to a latent image and evaporation of the liquid carrier from the image, the toner, aided by the wax at the indicated concentration level, is fixed to the surface without the need for externally applied heat.

12 Claims, No Drawings

SELF-FIXING LIQUID ELECTROGRAPHIC DEVELOPERS CONTAINING POLYESTER TONERS AND DISPERSED WAX AND PROCESSES FOR USING THE SAME

This invention relates to liquid electrographic developers which self-fix to smooth surfaces at room temperature. In particular, the invention relates to the use in volatile, electrically insulating liquid carriers of polyester toners and of wax above a threshold concentration.

In the now well-known area of electrography, image charge patterns are formed on the surface of a suitable dielectric material such as a film or paper support. The charge patterns (also referred to as latent electrostatic images), in turn, are rendered visible by treatment with an electrographic developer containing electroscopic marking particles which are attracted to the charge patterns. These particles are called toner particles.

Two major types of developers, liquid and dry, are employed in the development of the aforementioned charge patterns. The present invention is concerned with processes employing liquid developers. A liquid developer is composed of a dispersion of toner particles in an electrically insulating carrier liquid.

In use, a liquid developer is applied to the surface of a support bearing a charge pattern. The visible image is fixed to the surface generally by heating to temperatures above room temperature to fuse the toner to the support. Alternatively, as described in U.S. Pat. No. 3,954,640 issued May 4, 1976, to C. H. Lu et al, fixing to porous or fibrous supports can be accomplished at room temperature through the use of a linear addition polymer toner, having a low glass-transition temperature, and a nonvolatile carrier to carry the toner particles into the interstices of the support. In the latter instance, toner adhesion to the substrate is enhanced by entanglement within the pores or fibers of the support. Such developers however, are non-self fixing when employed on smooth nonporous surfaces such as film substrates.

Liquid developers containing dispersed wax are also described in the prior art. In the disclosure of U.S. Pat. No. 3,850,829 issued Nov. 26, 1974, to I. E. Smith et al, liquid developers are described which contain polyethylene wax as a release agent for images formed by such developers. Wax as a developer component is also reported in U.S. Pat. No. 4,081,391 to K. Tsubuko et al issued Mar. 28, 1978, as the agent responsible for the transferability of a toner image (column 3, lines 33–39). From these patents, wax would not be expected to contribute to the fixing of a toner image to a substrate at room temperature.

Copending U.S. patent application Ser. No. 249,330, entitled REPLENISHABLE LIQUID ELECTROGRAPHIC DEVELOPERS CONTAINING WAX, discloses heat-fixable developers containing a polyester toner and up to 3 parts by weight wax per part pigment. In the context of Ser. No. 249,330, Examples 1 and 2, this represents a maximum wax concentration of 0.25 gram wax per gram of polyester binder.

In accordance with the present invention, it has been unexpectedly found that liquid electrographic developers comprising a volatile liquid carrier, wax and polyester toner are self-fixing when the wax is employed in sufficiently high concentration; that is, toner images formed from these developers on a substrate, particularly a substrate with a smooth, nonporous surface, are fixed merely by exposure to room-temperature conditions. Developers of the present invention comprise a volatile, electrically insulating liquid carrier and, dispersed in the carrier, (a) toner particles comprising a polyester binder and (b) wax in a concentration above 0.25 part by weight wax per part polyester.

The present invention also provides a method of forming self-fixed toner images using certain liquid electtrographic developers. These developers comprise a volatile, electrically insulating liquid carrier and dispersed in the carrier, (a) toner particles comprising a polyester binder and (b) wax in a sufficient concentration to provide self-fixing, as defined hereinafter. Useful developers include those set forth above (i.e., those with a wax concentration greater than 0.25 part wax per part polyester), as well as those developers in which the concentration of wax is somewhat lower but otherwise sufficient to provide self-fixing. When the developer is contacted with an electrostatic latent image on a support and the carrier evaporated at room temperature, the toner and wax self-fix to the surface of the support without the need for externally applied heat.

As will be discussed below, preferred developers include polyethylene waxes, ionic polyester binders and optional components such as charge control agents, colorants, stabilizing agents and other liquid-developer constituents.

The carrier liquid employed according to the present invention is selected from a variety of materials which are volatile at room temperature. These materials should be electrically insulating and have a dielectric constant less than about 3.

The term "volatile" as employed herein signifies that the liquid carrier is capable of substantially complete evaporation from the surface of a toner image-bearing element during use. For example, when an electrostatic image on a film surface is contacted with a developer of the present invention, a visible image of toner particles will form on the film. In addition to toner, the film surface also contains residual carrier liquid associated with both the toner and background areas of the image. For purposes of the invention, the residual carrier must be capable of evaporating within about 60 seconds under ambient (room temperature) conditions. In this regard, it will be appreciated that the volatility of a liquid is not dependent solely on its boiling point as there are liquids with high boiling points which volatilize more rapidly than lowboiling-point liquids.

Useful carriers include one or more liquids having a dielectric constant of less than about 3 and a volume resistivity greater than about $10^{10}$ ohm/cm. Suitable carrier liquids include volatile halogenated hydrocarbon solvents, for example, fluorinated lower alkanes, such as trichloromonofluoromethane and trichlorotrifluoroethane. Preferred carriers are volatile alkylated aromatic liquids or isoparaffinic hydrocarbons having a boiling range of below 200° C. Representative preferred carriers include Isopar G® (sold by Exxon Corporation); cyclohydrocarbons, such as cyclohexane, or Solvesso 100® (sold by Humble Oil and Refining Co.).

The self-fixing developers of the present invention comprise, as a dispersed constituent, toner particles which serve as the principal developing constituent for an electrostatic latent image. These particles are composed of polyester binder. Preferably the polyester is amorphous, i.e., one which exhibits substantially no melting endotherm and broad X-ray diffraction maxima, as is typical of amorphous polymers. The glass-transition temperature, Tg, of the polymers, moreover, as determined by conventional differential scanning colorimetry, preferably exceeds 40° C., and most preferably is in the range from about 50° C. to about 150° C.

Suitable polyesters comprise recurring diol-derived units and recurring diacid-derived units. Preferred polyester binders have one or more aliphatic, alicyclic or aromatic dicarboxylic acid recurring units and recurring diol-derived units of the formula:

$$-O-G^1-O-$$

wherein:

$G^1$ represents straight- or branched-chain alkylene having about 2 to 12 carbon atoms or cycloalkylene, cycloalkylenebis(oxyalkylene) or cycloalkylene-dialkylene.

Most preferred polyesters are those which have up to 35 mole percent (based on the total moles of diacid units of ionic diacid-derived units of the structure:

$$-\overset{O}{\overset{\|}{C}}-A-\overset{O}{\overset{\|}{C}}-$$

wherein:

A represents sulfoarylene, sulfoaryloxyarylene, sulfocycloalkylene, arylsulfonyliminosulfonylarylene, iminobis(sulfonylarylene), sulfoaryloxysulfonylarylene and sulfoaralkylarylene or the alkali metal or ammonium salts thereof. The diol- and diacid-derived units set forth above can be unsubstituted or substituted as desired.

Such preferred polyester resins include, for example, the polyester ionomer resins disclosed in U.S. Pat. No. 4,202,785 issued May 13, 1980 to S. H. Merrill et al and the noncrystalline linear polyesters described in U.S. Pat. No. 4,052,325 issued Oct. 4, 1977, to D. Santilli, the disclosures of which are incorporated herein by reference.

In accordance with this invention, wax, as a carrier-insoluble constituent, in a sufficiently high concentration cooperates unexpectedly with the polyester binder and volatile carrier. In particular, when the developer contains sufficiently high concentrations of wax, preferably in excess of 0.25 part wax, by weight, per part polyester binder, the resulting developing composition is capable of self-fixing on an electrostatic image on a support at room temperature. This behavior is surprising in view of prior-art disclosures in which wax in developers is said to facilitate image transfer.

As noted previously, the concentration of wax in the novel developer of the present invention exceeds 0.25 parts wax, by weight, per part polyester binder. Preferably, a concentration from about 0.5 to about 1 part wax per part binder is employed. The skilled artisan will appreciate, of course, that some routine effort may be necessary to establish the concentration of a specific wax at which self-fixing, as defined below, commences.

Waxes employed in the present invention generally include low-molecular-weight waxes having a softening point of about 60° C. to about 130° C. A useful wax is a polyolefin wax, a triglyceride wax such as an hydrogenated vegetable or animal oil, or a natural wax. Preferably, the wax is a polyethylene wax which is available commercially from Eastman Chemical Products, Inc., under the Epolene® E series polyethylene waxes; Shamrock Chemicals Company (for example, wax types S-394 and S-395); and American Hoechst (for example, VP Ceridust® wax). Other suitable waxes are disclosed in U.S. Pat. No. 4,081,391 issued Mar. 28, 1978. Representative other waxes which are useful include carnauba wax, beeswax, ethylene-propylene copolymer waxes, paraffin waxes, long-chain petroleum waxes and amide waxes.

Waxes selected for use in the present invention can take the form of a separately dispersed constituent from the toner particles in the liquid carrier. Alternatively, the wax can be incorporated directly into the toner particle by melt-blending as discussed in greater detail below. Preferably, the wax is incorporated into the toner particles.

In general, developers which are useful for the present invention contain from about 0.5 to about 4 percent by weight of the defined amorphous polyesters, based on the total developer. These developers contain from about 99.5 to about 96 percent by weight of the volatile liquid-carrier vehicle.

Although it is possible to use the liquid developers of the present invention without further addenda, it is often desirable to incorporate in the developer, including the toner, such addenda as charge control agents, colorants and dispersing agents for the colorants and/or wax.

If a colorless image is desired, it is unnecessary to add any colorant. In such case, the resultant developer composition comprises the volatile liquid carrier, the amorphous polyester toner particles, and wax in the specified concentration.

In accordance with a preferred embodiment of the present invention, however, colorants such as carbon black pigments are also included as a toner constituent. A representative list of colorants is found in *Research Disclosure,* Vol. 109, May, 1973, in an article entitled "Electrophotographic Elements, Materials and Processes".

The colorant concentration, when colorant is present, varies widely with a useful concentration range, being about 10 to about 90 percent by weight of the total dispersed constituents. A preferred concentration range is from about 35 to about 45 percent by weight, based on the dispersed constituents.

Optionally, the self-fixing developers of the present invention include a charge control agent to enhance uniform charge polarity on the developer toner particles.

Various charge control agents have been described heretofore in the liquid-developer art and are useful in the developers of the present invention. Examples of such charge control agents may be found in Stahly et al U.S. Pat. No. 3,788,995 issued Jan. 29, 1974, which describes various polymeric charge control agents. Other useful charge control agents include phosphonate materials described in U.S. Pat. No. 4,170,563 and quaternary ammonium polymers described in U.S. Pat. No. 4,229,513.

Various nonpolymeric charge control agents are also useful, such as the metal salts described by Beyer, U.S. Pat. No. 3,417,019 issued Dec. 17, 1968. Other charge control agents known in the liquid-developer art may also be employed.

A partial listing of preferred representative polymeric charge control agents for use in the present invention includes poly(styrene-co-lauryl methacrylate-co-sulfoethyl methacrylate), poly(vinyltoluene-co-lauryl methacrylate-co-lithium methacrylate-co-methacrylic acid), poly(styrene-co-lauryl methacrylate-co-lithium sulfoethyl methacrylate), poly(vinyltoluene-co-lauryl methacrylate-co-lithium methacrylate), poly(styrene-co-lauryl methacrylate-co-lithium methacrylate), poly(t-butylstyrene-co-styrene-co-lithium sulfoethyl methacrylate), poly(t-butylstyrene-co-lauryl methacrylate-co-lithium methacrylate), poly(t-butylstyrene-co-lithium methacrylate), or poly(vinyltoluene-co-lauryl methacrylate-co-methacryloyloxyethyltriomethylammonium p-toluenesulfonate).

The amount of charge control agent used will vary depending upon the particular charge control agent and its compatibility with the other components of the developer. It is usually desirable to employ an amount of charge control agent within the range of from about 0.01 to about 10.0 weight percent based on the total weight of a working-strength liquid-developer composition. The charge control agent may be added in the liquid developer simply by dissolving or dispersing the charge control agent in the volatile liquid-carrier vehicle at the time concentrates or melt-blends of the components are combined with the liquid-carrier vehicle to form a working-strength developer.

Various techniques are employed to prepare a working-strength developer comprising the aforementioned polyesters. For example, as disclosed by Merrill et al in U.S. Pat. No. 4,202,785, one or more developer concentrates are prepared for each of the developer components. (A concentrate is a concentrated solution or dispersion of one or more developer components in a suitable volatile, electrically insulating liquid solvent for the binder.) The concentrates are then admixed in a preselected sequence, the admixture slurried with the carrier liquid to dilute the components, and the slurry homogenized to form the working-strength developer containing separately dispersed wax and toner particles.

Alternatively, the developer can be prepared without using a solvent for the polyester binder by melt-blending the dispersed constituents including the wax at a temperature above the melting temperature of the amorphous polyester. The resulting melt blend is cooled, pulverized and dispersed in the volatile carrier. The resulting dispersion is ball-milled to form toner particles incorporating both the wax and the polyester of the size desired.

The present liquid developers are employed to develop electrostatic charge patterns carried by various types of substrates. Preferably, the surface of the substrate to be developed is smooth, nonporous and, hence, impermeable to the developer carrier fluid. Such elements are either photoconductive themselves or are adapted to receive charge images, as disclosed by Gramza et al, U.S. Pat. No. 3,519,819 issued July 7, 1970. For example, the developers are employed with a photoconductive film element whose surface is coated with a nonporous arylmethane photoconductor composition such as disclosed by Contois et al, U.S. Pat. No. 4,301,226 issued Nov. 17, 1981.

The terms "fixing" or "fixed" as employed herein refer to the firm adhesion of a toner image to a substrate, and "self-fixing" refers to such adhesion upon evaporation of carrier at room temperature in the absence of externally applied heat (other than ambient heat) or pressure. Thus, a self-fixed image is rub-resistant and will not freely transfer to other contiguous surfaces. Qualitatively, the adhesion of images containing polyesters and wax to a smooth surface is at least sufficient to resist removal by heavy-pressure finger-rubbing, thus providing an imaged element which is immediately usable. In contrast, under the same development and evaporation conditions, an image containing insufficient wax for the amount of polyester employed will not adhere to the smooth surface; a sweep of a finger with light to moderate pressure over the image will easily remove the toner.

The adhesion of the present amorphous polyester/-wax images is also measurably better under room temperature development conditions and no other externally applied heat. For example, the adhesion of toner images regions can be subjected to finger-rubbing with finger pressure varying from light to moderate to heavy pressure. The ease with which the image is removed at each finger pressure is then noted, thus producing the following rank order of adhesion:

Non-self-fixing:

1. Image rubs off easily with light pressure.
2. Image rubs off with difficulty with light pressure.
3. Image rubs off easily with moderate pressure.
4. Image rubs off with difficulty with moderate pressure.
5. Image rubs off easily with heavy pressure.

Self-fixing:

6. Image rubs off with difficulty with heavy pressure.
7. Image is essentially rub-resistant.

Other tests of image adhesion can also be employed to demonstrate the self-fixing nature of the present developers. For example, one can employ an oily rub test to simulate finger-rubbing. The rub test comprises the application of a 700-gram weighted oleic acid-soaked patch approximately 5 mm in diameter to a toner-bearing image and oscillating a portion of the image back and forth underneath the absorbent patch. Oleic acid is chosen to simulate human oil. Rub resistance is determined as a range A to B, wherein A is the number of oscillatory passes (a pass being one movement of the patch back and forth) it takes to first interrupt the toner image integrity, while B represents the number of passes necessary to completely remove the subjected portion of the image by such rubbing. Specific toner images prepared in accordance with the present invention can be expected to exhibit an A value of from about 1 to about 9 passes and a B value of from about 2 to 12 passes. In the practice of this invention, higher A-B values are obtainable depending on such factors as the specific polyesters employed, as well as the nature of the smooth surface to which the toner is self-fixed.

The following examples are provided to aid in the understanding of the present invention.

EXAMPLES 1–16

The following components were melt-blended at 140° C.:

| | | Parts, by Weight |
|---|---|---|
| polyester binder: | poly[neopentyl-4-methylcyclohexene-1,2-dicarboxylate-co-terephthalate-co-5-(N—potassio-p-toluenesulfonamidosulfonyl)isophthalate)] 50/45/5, Tg 45° C. | 1.0 |
| pigment: | carbon black | 0.25 |
| dye: | nigrosine base | 0.25 |
| wax: | | X |
| dispersing agent: | Elvax 210 (an ethylene-vinyl | Y |

-continued

| | Parts, by Weight |
|---|---|
| acetate copolymer) | |

The resulting melt blend and two parts, by weight, per part binder of soluble stabilizer polymer were ball-milled with $\frac{1}{8}$" steel balls in Isopar G ® to make a developer having approximately 2 g of solids per liter of total developer.

The amounts of wax and dispersing agent were varied in the developers and the resulting developers were employed to develop electrostatic images on a Kodak Ektavolt ® recording film. Such films comprise a resinous layer of photoconductor compounds overlaying a conductive film support. The films were charged initially to +500 volts and exposed to neutral-density test targets are a distance of 33" from the film for 5 sec. The exposed films were immersed in the developers for 10–30 sec and the resulting images air-dried for about 1 min. The images were subjected to the rank-ordered, finger-rubbing test described previously. The results of this test are reported in Table 1.

TABLE 1

| Example | Wax Additive | Wax Concentration, X, (Parts per Weight Polyester Binder) | Dispersing Agent Concentration, Y, (Parts per Weight Binder) | Rub Test Rating |
|---|---|---|---|---|
| 1 | Epolene E-12 TM [1] | 0.0 | .125 | 3–4 |
| 2 | Epolene E-12 TM [1] | 0.0 | .25 | 3–4 |
| 3 | Epolene E-12 TM [1] | .125 | 0.0 | 3–4 |
| 4 | Epolene E-12 TM [1] | .25 | 0.0 | 6 |
| 5 | Epolene E-12 TM [1] | .5 | 0.0 | 7 |
| 6 | Epolene E-12 TM [1] | .075 | .05 | 3–4 |
| 7 | Epolene E-12 TM [1] | .0625 | .0625 | 3–4 |
| 8 | Glycowax S-932-F TM [2] | 0.125 | 0.125 | 4 |
| 9 | Glycowax S-932-F TM [2] | .25 | .25 | 5 |
| 10 | carnauba wax[3] | 0.125 | 0.125 | 6 |
| 11 | carnauba wax[3] | .25 | .25 | 7 |
| 12 | Epolene E-12 TM [1] | 0.125 | 0.125 | 6 |
| 13 | Epolene E-12 TM [1] | .25 | .25 | 7 |
| 14 | Epolene E-12 TM [1] | .5 | .25 | 7 |
| 15 | Shamrock S-934-NS TM [4] | 0.125 | 0.125 | 6 |
| 16 | | .5 | .25 | 7 |

[1]a polyethylene wax having a softening point of 101–104° C. from Tennessee Eastman Co.
[2]a triglyceride wax having a softening point of 60–62° C. from Glyco Chemicals, Inc.
[3]softening point of 81–86° C.
[4]A polyethylene wax having a softening point of 93–117° C. from Shamrock Chemicals Co.

The results in Table 1 demonstrate that self-fixed images having level 6 or greater rub resistance (Examples 4–5 and 10–16) occur when the amount of wax in the developer is sufficiently high and that consistently good results occur when the level of wax exceeds 0.25 part by weight per part polyester binder (Examples 5, 14 and 16). In some instances, the amount of wax required for level 6 rub resistance is less when the developer also contains wax dispersing agent (Example 12 compared with Example 3).

Although the invention has been described in considerable detail with particular reference to certain preferred embodiments thereof, variations and modifications can be effected within the spirit and scope of the invention.

I claim:

1. An electrographic method of forming a self-fixed toner on a support, comprising:

(a) establishing a latent electrostatic image on the surface of said support (b) developing said image with a self-fixing, liquid electrographic developer comprising a volatile, electrically insulating liquid carrier and, dispersed in said carrier, (i) toner particles comprising a polyester binder and (ii) wax, to form an unfixed toner image comprising said toner, wax and volatile carrier, and (c) fixing said toner image by allowing said volatile carrier to evaporate from said toner image at room temperature, wherein the concentration of said wax in said developer is sufficient to fix said toner and wax to said surface in the absence of externally applied heat other than that from ambient conditions.

2. The method of claim 1 wherein said wax is a polyolefin wax, a triglyceride wax or a natural wax.

3. The method of claim 1 wherein said wax comprises a polyethylene wax in a concentration of about 0.125 to 1.0 part by weight wax per part polyester.

4. The method of claims 1, 2 or 3 wherein said volatile liquid carrier is an isoparaffinic hydrocarbon.

5. An electrographic method of forming a self-fixed image on a support having a smooth, nonporous surface, comprising:

(a) establishing a latent electrostatic image on said smooth, nonporous surface, (b) developing said image with a self-fixing, liquid electrographic developer comprising a volatile, electrically insulating, liquid carrier and, dispersed in said carrier, (i) toner particles comprising a polyester binder having one or more aliphatic, alicyclic or aromatic dicarboxylic acid recurring units and recurring diol units of the formula:

$$-O-G^1-O-$$

wherein $G^1$ represents straight- or branched-chain lkylene having about 2 to 12 carbon atoms or cycloalkylene, cycloalkylene-bis(oxyalkylene) or cycloalkylenedialkylene, and (ii) wax incorporated into said toner, to form an unfixed toner image comprising said toner, wax and volatile carrier, and (c) fixing said toner image by allowing said volatile carrier to evaporate from said toner image at room temperature, wherein the concentration of said wax in said developer is sufficient to fix said toner and wax to said surface in the absence of externally applied heat other than that from ambient conditions.

6. The method of claim 5 wherein said polyester comprises up to 35 mole percent (based on the total moles of diacid units) of an ionic diacid unit of the structure:

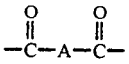

wherein:

A represents sulfoarylene, sulfoaryloxyarylene, sulfocycloalkylene, arylsulfonylimino, sulfonylarylene, iminobis(sulfonylarylene), sulfoaryloxysulfonylarylene and sulfoaralkylarylene or the alkali metal or ammonium salts thereof.

7. The method of claims 5 or 6 wherein said surface is a smooth, nonporous photoconductive layer comprising a photoconductor and a film-forming polymeric binder for said photoconductor.

8. The method of claims 5 or 6 wherein said surface is a smooth, nonporous, nonphotoconductive dielectric receiving layer.

9. The method of claims 5 or 6 wherein said surface is a film surface.

10. The method of claims 5 or 6 wherein said wax is a polyolefin wax, a triglyceride wax or a natural wax.

11. The method of claims 5 or 6 wherein said wax comprises a polyethylene wax in a concentration of about 0.125 to 1.0 part by weight wax per part polyester.

12. The method of claims 5 or 6 wherein said volatile liquid carrier is an isoparaffinic hydrocarbon.

* * * * *